US006318981B1

(12) United States Patent
Ebara et al.

(10) Patent No.: US 6,318,981 B1
(45) Date of Patent: Nov. 20, 2001

(54) TWO-CYLINDER TYPE TWO-STAGE COMPRESSION ROTARY COMPRESSOR

(75) Inventors: Toshiyuki Ebara; Satoshi Imai; Masaya Tadano; Atsushi Oda; Takashi Yamakawa, all of Moriguchi (JP)

(73) Assignee: Sanyo Electric Co., Ltd., Moriguchi (JP)

( * ) Notice: Subject to any disclaimer, the term of this patent is extended or adjusted under 35 U.S.C. 154(b) by 0 days.

(21) Appl. No.: 09/650,767

(22) Filed: Aug. 29, 2000

(30) Foreign Application Priority Data

Aug. 31, 1999 (JP) ..... 11-245004
Mar. 31, 2000 (JP) ..... 12-097487

(51) Int. Cl.[7] ..... F04C 18/356; F04C 23/00
(52) U.S. Cl. ..... 418/11; 418/60
(58) Field of Search ..... 418/11, 12, 60

(56) References Cited

U.S. PATENT DOCUMENTS 1,929,999 * 10/1933 Wilson ..... 418/60

FOREIGN PATENT DOCUMENTS 53-103212 * 9/1978 (JP) ..... 418/60

* cited by examiner

*Primary Examiner*—John J. Vrablik
(74) *Attorney, Agent, or Firm*—Armstrong, Westerman, Hattori, McLeland & Naughton, LLP

(57) ABSTRACT

A two-cylinder type two-stage compression rotary compressor has an electric motor portion in a closed container and upper and lower cylinders driven by a rotating shaft of the electric motor portion; the insides of the respective cylinders are partitioned by upper and lower vanes and upper and lower rollers which are fitted to upper and lower eccentric portions provided to the rotating shaft to eccentrically rotate in the upper and lower cylinders; a lower stage side compression portion for sucking and compressing a refrigerant gas to be discharged, a high stage compression portion, and an intermediate partition plate provided between the both compression portions to insert the rotating shaft therethrough are included; the upper and lower eccentric portions provided to the rotating shaft have a phase difference of 180 degrees; a connecting portion for connecting the both eccentric portions has such a non-circular cross-sectional shape such as that the thickness in a direction orthogonal to an eccentric direction is set larger than the thickness in the eccentric direction; the cross-sectional area is larger than the cross-sectional area of the rotating shaft.

3 Claims, 4 Drawing Sheets

TWO-CYLINDER TYPE TWO-STAGE COMPRESSION ROTARY COMPRESSOR

BACKGROUND OF THE INVENTION (i) Field of the Invention

The present invention relates to a two-cylinder type two-stage compression rotary compressor, and more particularly to a two-cylinder type two-stage compression rotary compressor having two cylinders on both sides of, e.g., an intermediate partition plate.

(ii) Description of the Related Art

Conventionally, in this type of rotary compressor, when a refrigerant having a large difference between a high pressure and a low pressure, for example, carbon dioxide ($CO_2$) is used, a refrigerant pressure reaches approximately 100 kg/cm$^2$G on a high pressure side (high stage side), whilst it is approximately 30 kg/cm$^2$G on a low pressure side (low stage side). As a result, a difference between a high pressure and a low pressure becomes as large as approximately 70 kg/cm$^2$G.

Therefore, when a cross-sectional shape of a connecting portion for connecting two eccentric portions provided to a rotating shaft of a two-cylinder type two-stage compression rotary compressor with a phase difference of 180° is a circular form coaxial with the both eccentric portions, the cross-sectional area which can be physically assured becomes small. Thus, in case of the above-described refrigerant having a high working pressure, i.e., the carbon dioxide ($CO_2$), a large difference between a high pressure and a low pressure increases a burden imposed on the rotating shaft, which involves such a problem as that the rotating shaft is apt to be elastically deformed.

When the rotating shaft is elastically deformed in this manner, one side of the rotating shaft is brought into contact with a bearing portion to cause an abnormal abrasion to reduce the durability, and vibrations or noises are also generated.

SUMMARY OF THE INVENTION

It is therefore an object of the present invention is to provide a two-cylinder type two-stage compression rotary compressor which has the excellent durability for preventing a rotating shaft from being elastically deformed even if a refrigerant having a high working pressure is used.

The present invention provides a two-cylinder type two-stage compression rotary compressor comprising: a closed container; an electric motor portion accommodated in the closed container; two cylinders driven by a rotating shaft of the electric motor portion; and a rotary compression mechanism portion which eccentrically rotates a roller fitted to an eccentric portion provided to the rotating shaft in each cylinder, partitions the inside of each cylinder by a vane, and sucks, compresses and discharges a refrigerant gas, the rotary compression mechanism portion including: a low stage side compression portion which sucks and compresses a low pressure refrigerant gas, a high stage side compression portion which sucks and compresses the refrigerant gas which has compressed to be boosted to have an intermediate pressure on the low stage side compression portion; and an intermediate partition plate which is provided between the both compression portions to insert the rotating shaft therethrough, wherein the two eccentric portions provided to the rotating shaft has a phase difference of 180°, a cross-sectional shape of a connecting portion for connecting the both eccentric portions is such that its thickness in a direction orthogonal to an eccentric direction is larger than the thickness in the eccentric direction.

Since the cross-sectional area of the connecting portion for connecting the two eccentric portions provided to the rotating shaft with a phase difference of 180° can be set large, the rigidity strength of the rotating shaft can be improved so that the rotating shaft can be prevented from being elastically deformed.

According to the present invention, the rotating shaft can be prevented from being elastically deformed even if a difference between a high pressure and a low pressure is large, and the two-cylinder type two-stage compression rotary compressor with the high durability and the excellent reliability can be obtained.

DETAILED DESCRIPTION OF THE PREFERRED EMBODIMENTS

Figure 1:
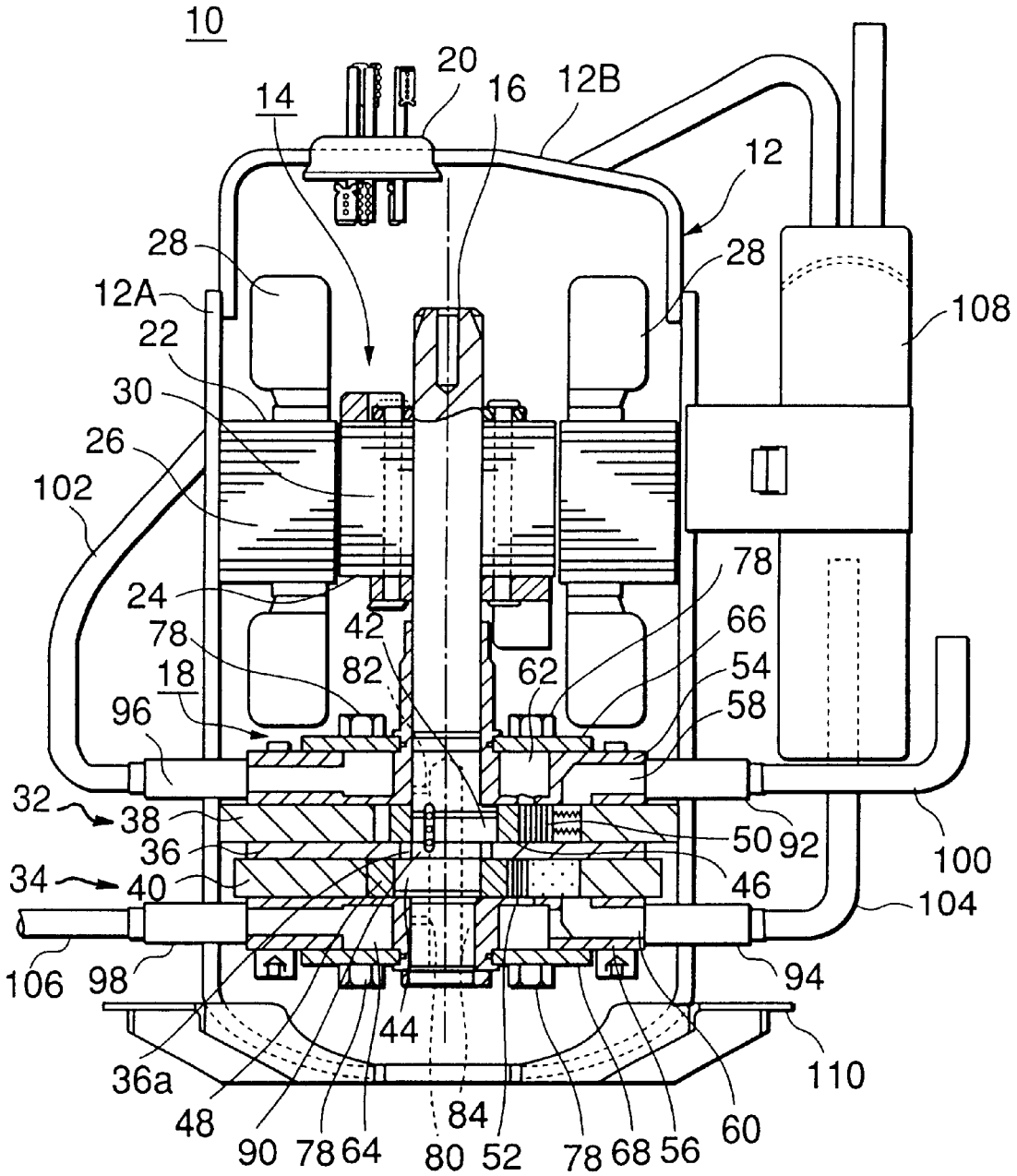
FIG. 1 is a diagram of a two-cylinder type two-stage compression rotary compressor which is of an internal low pressure type, showing an embodiment according to the present invention.

Embodiments according to the present invention will now be described in detail with reference to the accompanying drawings.

A two-cylinder type two-stage compression rotary compressor 10 which is of an internal low pressure type according to an embodiment of the present invention includes: a cylindrical closed container 12 consisting of a steel plate; an electric motor portion 14 which is arranged and accommodated in the internal space of the closed container 12; and a rotary compression mechanism portion 18 driven by a rotating shaft 16 of the electric motor 14.

The cylindrical closed container 12 has its bottom part as an oil bank and is constituted by two members, i.e., a container main body 12A for accommodating therein the electric motor portion 14 and the rotary compression mechanism portion 18, and a bowl-like cover body 12B for closing the upper opening of the container main body 12A. Further, a terminal (wiring is omitted) 20 for supplying power to the electric motor portion 14 is provided to the cover body 12B.

The electric motor portion 14 is constituted by a stator 22 annularly attached along the inner peripheral surface of the upper space of the cylindrical closed container 12, and a rotor 24 inserted and arranged inside the stator 22 with a small gap therebetween. The rotating shaft 16 extending through the center in the vertical direction is fixed to the rotor 24.

The stator 22 has a layered product 26 on which a ring-like electromagnetic steel plate superimposed thereon and a stator coil 28 wound around the layered product 26. In addition, the rotor 24 is formed by a layered product 30 which is an electromagnetic steel plate as similar to the stator 22. The both members constitute an alternating current motor. It is to be noted that the alternating current motor can be substituted by a DC motor in which a permanent magnet is embedded.

The rotary compression mechanism portion 18 includes: a low stage side compression portion 32; a high stage side compression portion 34; and an intermediate partition plate 36 which is sandwiched between the both compression portions 32 and 34 and has an insertion hole 36*a* for inserting the rotating shaft 16 therethrough. That is, it is constituted by: the intermediate partition plate 36; upper and lower cylinders 38 and 40 arranged on the upper and lower sides of the intermediate partition plate 36; upper and lower rollers 46 and 48 which are fitted to upper and lower eccentric portions 42 and 44 provided to the rotating shaft 16 with a phase difference of 180° degrees in the upper and lower cylinders 38 and 40 and which eccentrically rotate; upper and lower vanes 50 and 52 which are in contact with the upper and lower rollers 46 and 48 to partition the insides of the upper and lower cylinders 38 and 40 into low pressure chamber sides 38*a* and 40*a* and high pressure chamber sides 38*b* and 40*b*; and upper supporting member 54 and a lower supporting member 56 which close the respective opening surfaces of the upper and lower cylinders 38 and 40 to also serve as the bearing of the rotating shaft 16.

Inlet passages 58 and 60 which appropriately communicate with the inside of the upper and lower cylinders 38 and 40 and outlet sound absorbing chambers 62 and 64 are formed to the upper supporting member 54 and the lower supporting member 56, and the opening portions of the both outlet sound absorbing chambers 62 and 64 are closed by an upper plate 66 and a lower plate 68.

Figure 2:
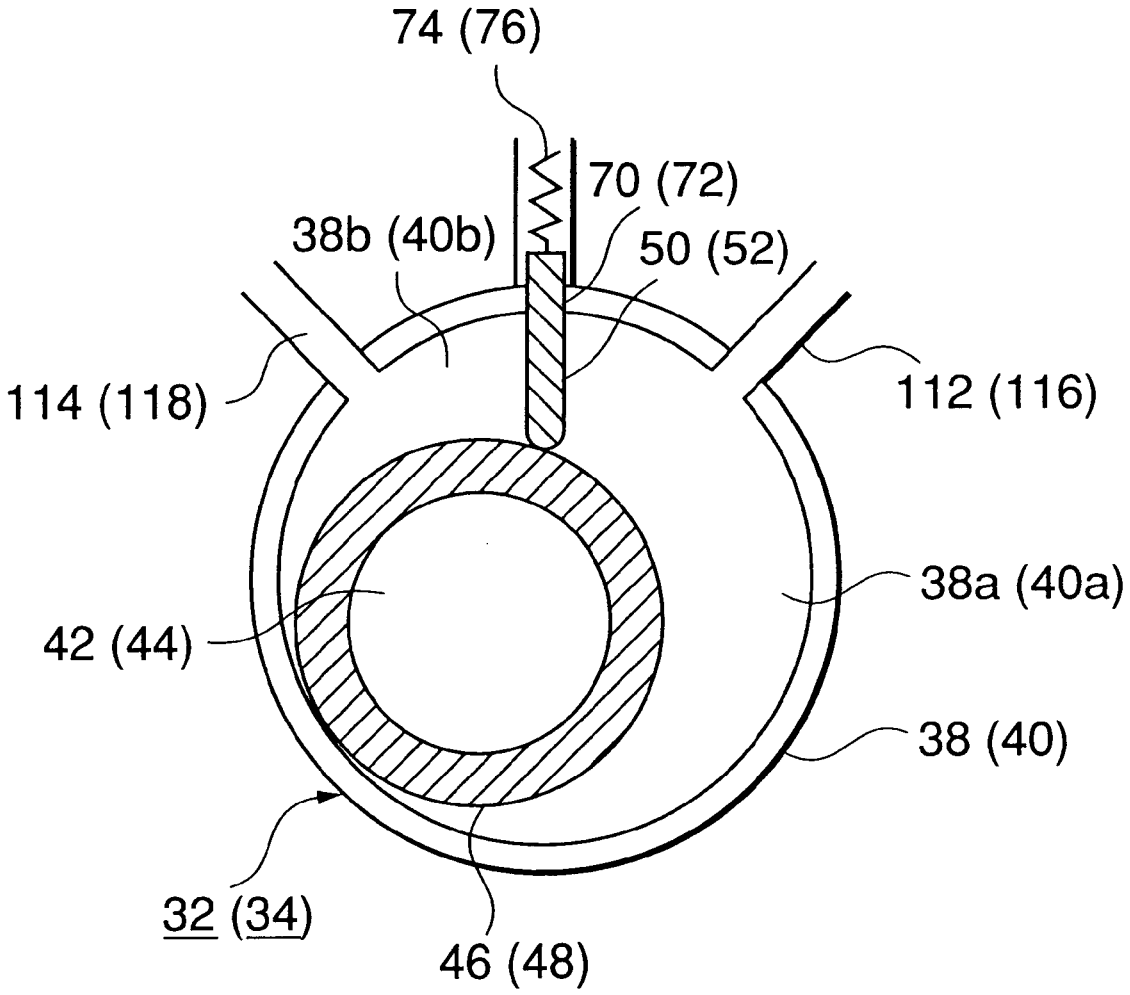
FIG. 2 is a diagram for explaining the structure of each compression portion in FIG. 1.

Further, as shown in FIG. 2, the upper and lower vanes 50 and 52 are arranged and accommodated in radial guide grooves 70 and 72 formed to cylinder walls of the upper and lower cylinders 38 and 40 so as to be capable of reciprocating. Also, these vanes 50 and 52 are constantly pushed against the upper and lower rollers 46 and 48 by springs 74 and 76.

The compression operation of the first stage (low stage side) is carried out in the upper cylinder 38, and the compression operation of the second stage (high stage side) for further compressing the refrigerant gas which has been compressed in the upper cylinder 38 to be boosted to have an intermediate pressure is performed in the lower cylinder 40.

Among elements constituting the above-described rotary compression mechanism portion 18, the upper supporting member 54, the upper cylinder 38, the intermediate partition plate 36, the lower cylinder 40 and the lower supporting member 56 are arranged in the mentioned order. They are further integrally connected and fixed together with the upper plate 66 and the lower plate 68 by using a plurality of fixing bolts 78.

Moreover, an oil hole 80 which is vertical to the shaft center is formed to the lower portion of the rotating shaft 16 and lateral fill holes 82 and 84 are formed to this oil hole 80.

A connecting portion 90 for connecting between the upper and lower eccentric portions 42 and 44 formed integrally with the rotating shaft 16 with a phase difference of 180° degrees has a non-circular cross-sectional shape in order that its cross-sectional area is made to be larger than the circular cross section of the rotating shaft 16 to provide the rigidity.

Figure 3:
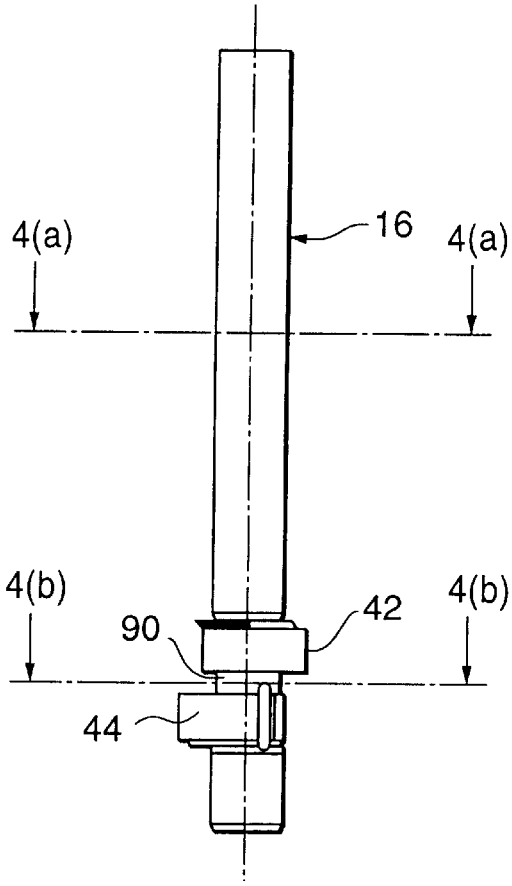
FIG. 3 is a plan view showing an embodiment of a rotating shaft including upper and lower eccentric portions in FIG. 1.
Figure 4A:
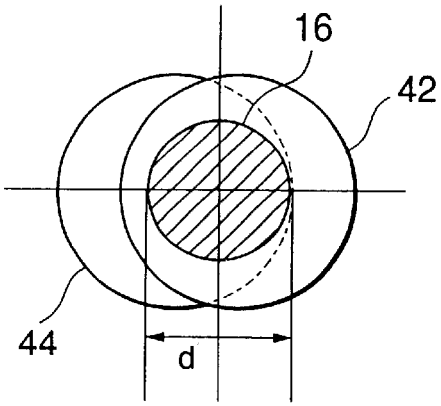
FIGS. 4(*a*) and 4(*b*) are cross-sectional views taken along the 4(*a*)—4(*a*) line and the 4(*b*)—4(*b*) line indicated by arrows, respectively.
Figure 4B:
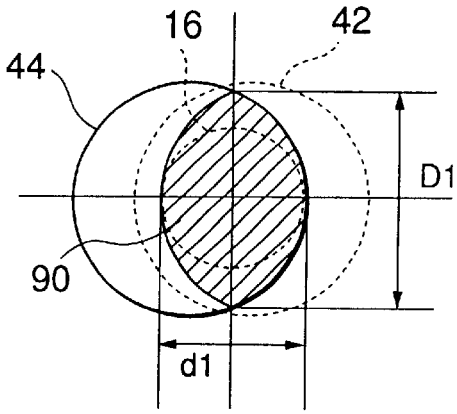

That is, as shown in FIGS. 3, 4(*a*) and 4(*b*), although the connecting portion 90 for connecting the upper and lower eccentric portions 42 and 44 provided to the rotating shaft 16 is coaxial with the rotating shaft 16, the cross section of the connecting portion 90 has such a shape as that the thickness in a direction orthogonal to the eccentric direction of the upper and the lower eccentric portions 42 and 44 is larger than the thickness in the eccentric direction. In this case, as apparent from FIGS. 4(*a*) and 4(*b*), a thickness d1 in the eccentric direction of the upper and lower eccentric portions 42 and 44 is the same with a diameter d of the rotating shaft 16, but a thickness D1 in a direction orthogonal to the eccentric direction is larger than the former thickness (D1>d1=d). That is, a non-circular cross-sectional area S1 of the connecting portion 90 is larger than a circular cross-sectional area S of the rotating shaft 16 (S1>S). It is to be noted that the cross-sectional form of the connecting portion 90 in this case is vertically and horizontally asymmetric like a rugby ball.

Figure 5:
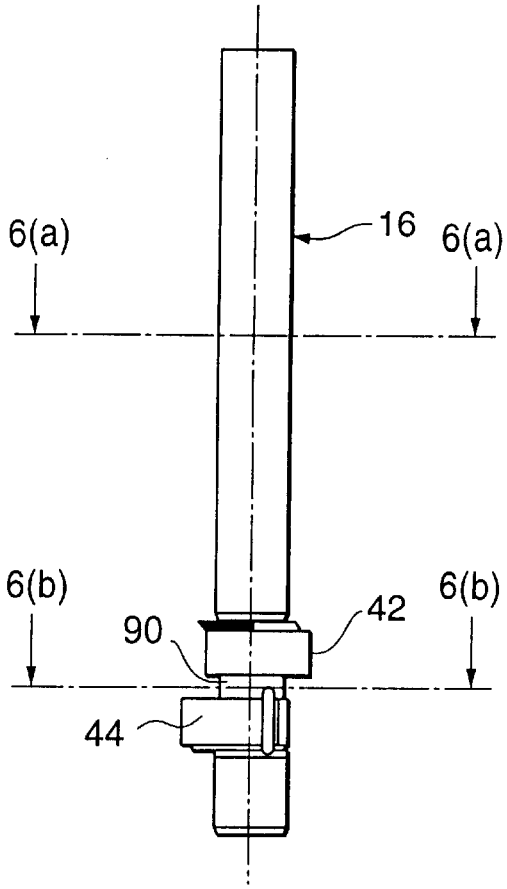
FIG. 5 is a plan view showing another embodiment of the rotating shaft and others including the upper and lower eccentric portions in FIG. 1.
Figure 6A:
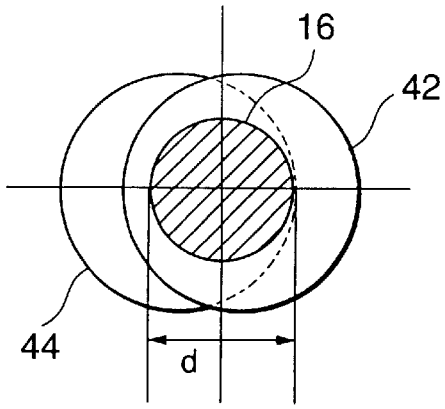
FIGS. 6(*a*) and 6(*b*) are cross-sectional views taken along the 6(*a*)—6(*a*) line and the 6(*b*)—6(*b*) line indicated by arrows in FIG. 5.
Figure 6B:
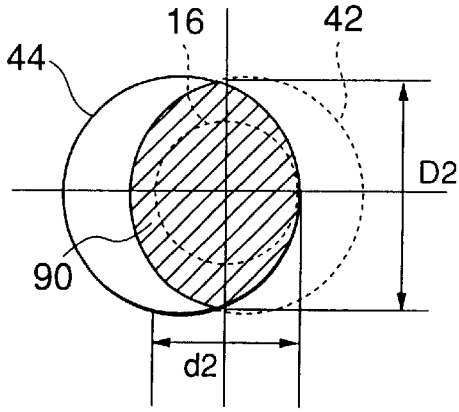

Additionally, in another embodiment shown in FIGS. 5, 6(*a*) and 6(*b*), a thickness d2 in the eccentric direction of the connecting portion 90 connecting the upper and lower eccentric portions 42 and 44 provided to the rotating shaft 16 is larger than the diameter d of the rotating shaft 16, and a thickness D2 in a direction orthogonal to the eccentric direction is larger than the former (=d2) (D2>d2>d), as apparent from FIGS. 6(*a*) and 6(*b*). In this case, the non-circular cross-sectional area S2 of the connecting portion 90 is similarly larger than the non-circular cross-sectional area S1 in the foregoing embodiment (S2>Si>S).

In this case, the connecting portion 90 has such a cross-sectional shape as that the thickness on the eccentricity side of the lower eccentric portion 44 is larger than the thickness on the eccentricity side of the upper eccentric portion 42.

As a result, the cross-sectional area of the connecting portion 90 for connecting the upper and lower eccentric portions 42 and 44 integrally provided to the rotating shaft 16 becomes large to increase the geometric secondary moment so that the strength (rigidity) is enhanced, thereby improving the durability and the reliability. Specifically, when compressing the later-described refrigerant having a high working pressure in two stages, although a large difference between a high pressure and a low pressure increases a load imposed on the rotating shaft 16, the cross-sectional area of the connecting portion 90 is increased to enhance the strength (rigidity), which prevents the rotating shaft 16 from being elastically deformed.

In this embodiment, the carbon dioxide ($CO_2$) which is earth-friendly and a natural refrigerant is used as a refrigerant taking the combustibility, the toxicity and others into consideration, and any existing oil such as mineral oil, alkylbenzene oil, ether oil, ester oil is used as lubricating oil.

Refrigerant inlet pipes 92 and 94 for leading the refrigerant gas into the upper and lower cylinders 38 and 40 through the inlet passages 58 and 60 and the outlet sound absorbing chambers 62 and 64 and refrigerant outlet pipes 96 and 98 for discharging the compressed refrigerant gas are respectively connected to the upper supporting member 54 and the lower supporting member 56. Additionally, refrigerant pipings 100, 102, 104 and 106 are respectively connected to these refrigerant inlet pipes 92 and 94 and the refrigerant outlet pipes 96 and 98. Also, an accumulator 108 is connected between the refrigerant pipings 102 and 104. It is to be noted that a mounting seat 110 is provided on the outer bottom surface of the closed container 12.

The overview of the operation of the above-described embodiment will now be described.

When the coil 28 of the electric motor portion 14 is first energized through the terminal 20 and a non-illustrated wiring, the electric motor portion 14 is activated to rotate the rotor 24. This rotation causes the upper and lower rollers 46 and 48 fitted to the upper and lower eccentric portions 42 and 44 integrally provided to the rotating shaft 16 to eccentrically rotate in the upper and lower cylinders 38 and 40.

Consequently, as shown in FIG. 2, the low-pressure refrigerant gas sucked from an inlet port 112 into the low pressure chamber side 38*a* of the upper cylinder 38 through the refrigerant piping 100, the refrigerant inlet pipe 92 and the inlet passage 58 formed to the upper supporting member 54 is compressed by the operation of the upper roller 46 and the upper vane 50 to have an intermediate pressure. It is then sent from the high pressure chamber side 38*b* of the upper cylinder 38 to the accumulator 108 arranged to the outside of the closed container 12 through the outlet port 114, the outlet sound absorbing chamber 62 formed to the upper supporting member 54, the refrigerant outlet pipe 96 and the refrigerant piping 102.

The refrigerant gas with an intermediate pressure which has been sucked from the inlet port 116 to the low pressure chamber side 40*a* of the lower cylinder 40 through the accumulator 108, the refrigerant piping 104, the refrigerant inlet pipe 94 and the inlet passage 60 formed to the lower supporting member 56 is subjected to the second-stage compression by the operation of the lower roller 48 and the lower vane 52 to become a high-pressure refrigerant gas. It is then sent from the high pressure chamber side 40*b* to an external refrigerant circuit (not shown) constituting a freezing cycle through the outlet port 118, the outlet sound absorbing chamber 64 formed to the lower supporting member 56, the refrigerant outlet pipe 98 and the refrigerant piping 106 to demonstrate the cooling behavior.

Rotation of the rotating shaft 16 causes the lubricating oil reserved at the bottom of the closed container 12 to move up through the vertical oil hole 80 formed to the shaft center of the rotating shaft 16, and the oil then flows out from the lateral fill holes 82 and 84 provided on the way to be supplied to the bearing portion of the rotating shaft 16 and the upper and lower eccentric portions 42 and 44. As a result, the rotating shaft 16 and the upper and lower eccentric portions 42 and 44 can smoothly rotate.

Although the foregoing embodiments have described the two-cylinder type two-stage compression rotary compressor having the rotating shaft 16 provided in the lengthwise direction, it is needless to say that the present invention can be similarly applied to the two-cylinder type two-stage compression rotary compressor having the rotating shaft provided in the crosswise direction.

According to the above-described present invention, the rotating shaft can be prevented from being elastically deformed even if a difference between a high pressure and a low pressure is large, and the two-cylinder type two-stage compression rotary compressor having the excellent durability and the high reliability can be provided.

What is claimed is:

1. A two-cylinder type two-stage rotary compressor comprising: a closed container; an electric motor portion accommodated in said closed container; two cylinders driven by a rotating shaft of said electric motor portion; and a rotary compression mechanism portion which eccentrically rotate rollers fitted to eccentric portions provided to said rotating shaft in said respective cylinders, partitions the inside of said respective cylinders by vanes, and sucks and compresses a low-pressure refrigerant gas to be discharged, said rotary compression mechanism portion including: a low stage side compression portion for sucking a low pressure refrigerant gas to be compressed; a high stage side compression portion for sucking and compressing the refrigerant gas which is compressed by said low stage side compression portion to be boosted to have an intermediate portion; and an intermediate partition plate provided between said both compression portions to insert said rotating shaft therethrough, wherein two eccentric portions provided to said rotating shaft has a phase difference of 180 degrees, and a connecting portion for connecting said both eccentric portions has a cross-sectional shape such that the thickness in a direction orthogonal to an eccentric direction is set larger than the thickness in the eccentric direction.

2. The two-cylinder type two-stage compression rotary compressor according to claim 1, wherein the cross-sectional shape of said connecting portion is non-circular.

3. The two-cylinder type two-stage compression rotary compressor according to claim 1 or claim 2, wherein a cross-sectional area of said connecting portion is larger than a cross-sectional area of said rotating shaft.

* * * * *